United States Patent [19]

Misevich et al.

[11] Patent Number: 4,860,464

[45] Date of Patent: Aug. 29, 1989

[54] TRANSVERSE SUPPORT SLING

[75] Inventors: Kenneth W. Misevich, Piscataway, N.J.; Rob R. McGregor, Concord, Mass.; Thomas E. Mintel, Somerset, N.J.

[73] Assignee: Colgate-Palmolive Company, Piscataway, N.J.

[21] Appl. No.: 36,774

[22] Filed: Apr. 9, 1987

[51] Int. Cl.[4] ..... A43B 7/14; A43B 11/00

[52] U.S. Cl. ..... 36/114; 36/50; 128/611

[58] Field of Search ..... 36/88, 91, 97, 50, 58.5, 36/119, 114; 128/800, 611

[56] References Cited

U.S. PATENT DOCUMENTS

| | | | |
|---|---|---|---|
| 1,058,561 | 4/1913 | Davis | 128/611 |
| 1,258,629 | 3/1918 | Bliss | 128/611 |
| 1,495,107 | 5/1924 | Reed | 128/611 |
| 1,649,173 | 11/1927 | McDonough | 128/611 |
| 1,712,481 | 5/1929 | Ayers | 128/611 |
| 1,833,628 | 11/1931 | Woodruff | 128/611 |
| 1,976,819 | 10/1934 | Weiler | 128/611 |
| 2,068,251 | 1/1937 | Ullrich | 128/611 |
| 2,116,445 | 5/1938 | Moore | 128/611 |
| 2,182,843 | 12/1939 | Flynn et al. | 128/611 |
| 2,191,210 | 2/1940 | Johnson | 128/611 |
| 2,279,951 | 4/1942 | Morein | 128/611 |
| 2,539,761 | 1/1951 | Whitman | 128/611 |
| 2,734,285 | 2/1956 | Levitt | 128/581 |
| 2,933,835 | 4/1960 | Aronoff | 128/582 |
| 3,327,410 | 6/1967 | Park, Sr. et al. | 36/89 |
| 3,464,125 | 9/1969 | Conway | 36/114 |
| 3,566,486 | 3/1971 | Conway | 36/114 |
| 4,114,297 | 9/1978 | Famolare, Jr. | 36/50 |
| 4,476,639 | 10/1984 | Zaccaria | 36/116 |
| 4,550,511 | 11/1985 | Gamm | 36/50 |
| 4,592,154 | 6/1986 | Oatman | 36/114 |
| 4,616,432 | 10/1986 | Bunch et al. | 36/50 |
| 4,624,914 | 2/1987 | Caldeira | 36/114 |

FOREIGN PATENT DOCUMENTS

| | | | |
|---|---|---|---|
| 10575 | 11/1933 | Australia . | |
| 206101 | 6/1955 | Australia . | |
| 1190740 | 7/1985 | Canada . | |
| 061971 | 6/1982 | European Pat. Off. . | |
| 441042 | 2/1927 | Fed. Rep. of Germany . | |
| 1050234 | 2/1959 | Fed. Rep. of Germany . | |
| 8429363 | 3/1985 | Fed. Rep. of Germany . | |
| 741655 | 2/1933 | France . | |
| 1258562 | 3/1961 | France | 36/114 |
| 59100 | 3/1938 | Norway . | |
| 130996 | 3/1929 | Switzerland . | |
| 304703 | 4/1955 | Switzerland . | |
| 11329 | 6/1916 | United Kingdom . | |
| 267757 | 3/1927 | United Kingdom . | |
| 512449 | 9/1939 | United Kingdom | 128/611 |

*Primary Examiner*—Steven N. Meyers

*Attorney, Agent, or Firm*—Richard J. Ancel; Murray M. Grill; Robert C. Sullivan

[57] ABSTRACT

A foot support structure attached to the outsole of a shoe to provide support to the medial arch and to girth the midfoot in a sling configuration is disclosed. The support structure includes a plurality of sling straps attached to the outsole in positions beneath the upper and lower columns of the foot. In one embodiment, the sling straps which are attached beneath the upper, medial column are mounted in an arcuate slot in the upper surface of the outsole. The sling straps attached beneath the lower, lateral column are mounted in a linear slot in the upper surface of the outsole. By the present invention, the position of the foot relative to the shoe is maintained due to anchoring of the transverse sling in the outsole, and this is accomplished without pulling or pushing the medial longitudinal arch to the shoe. the sling straps are positioned relative top the outsole so as to coincide with certain anatomical landmarks of the foot. The straps are each capable of being adjusted for length independently.

11 Claims, 4 Drawing Sheets

FIG. 1 PRIOR ART
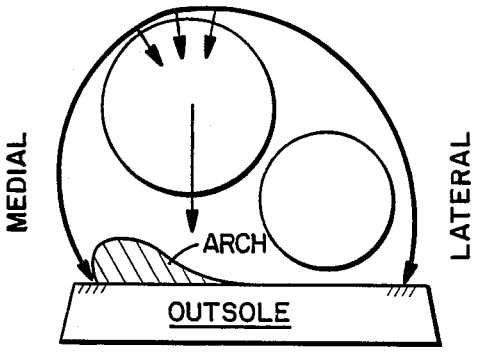
FIG. 2
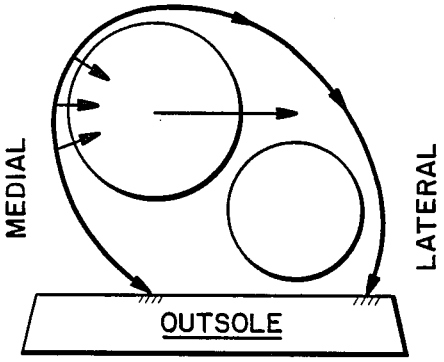
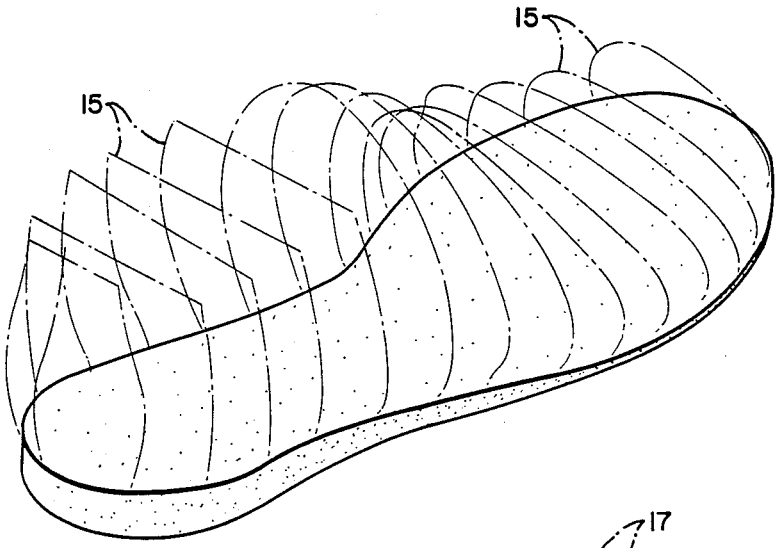
FIG. 3
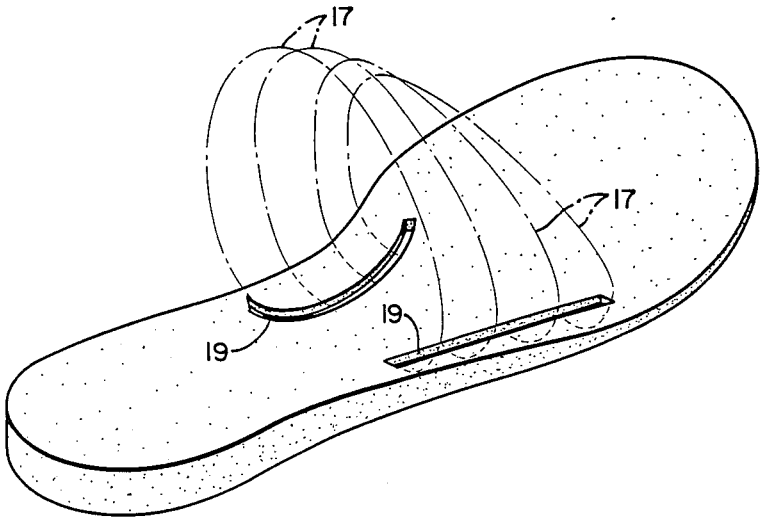
FIG. 4

FIG. 5
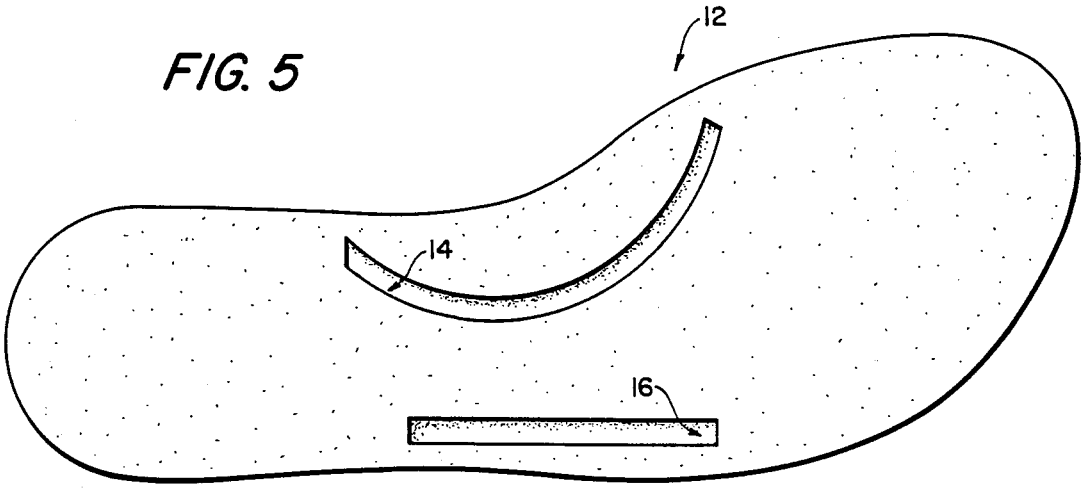
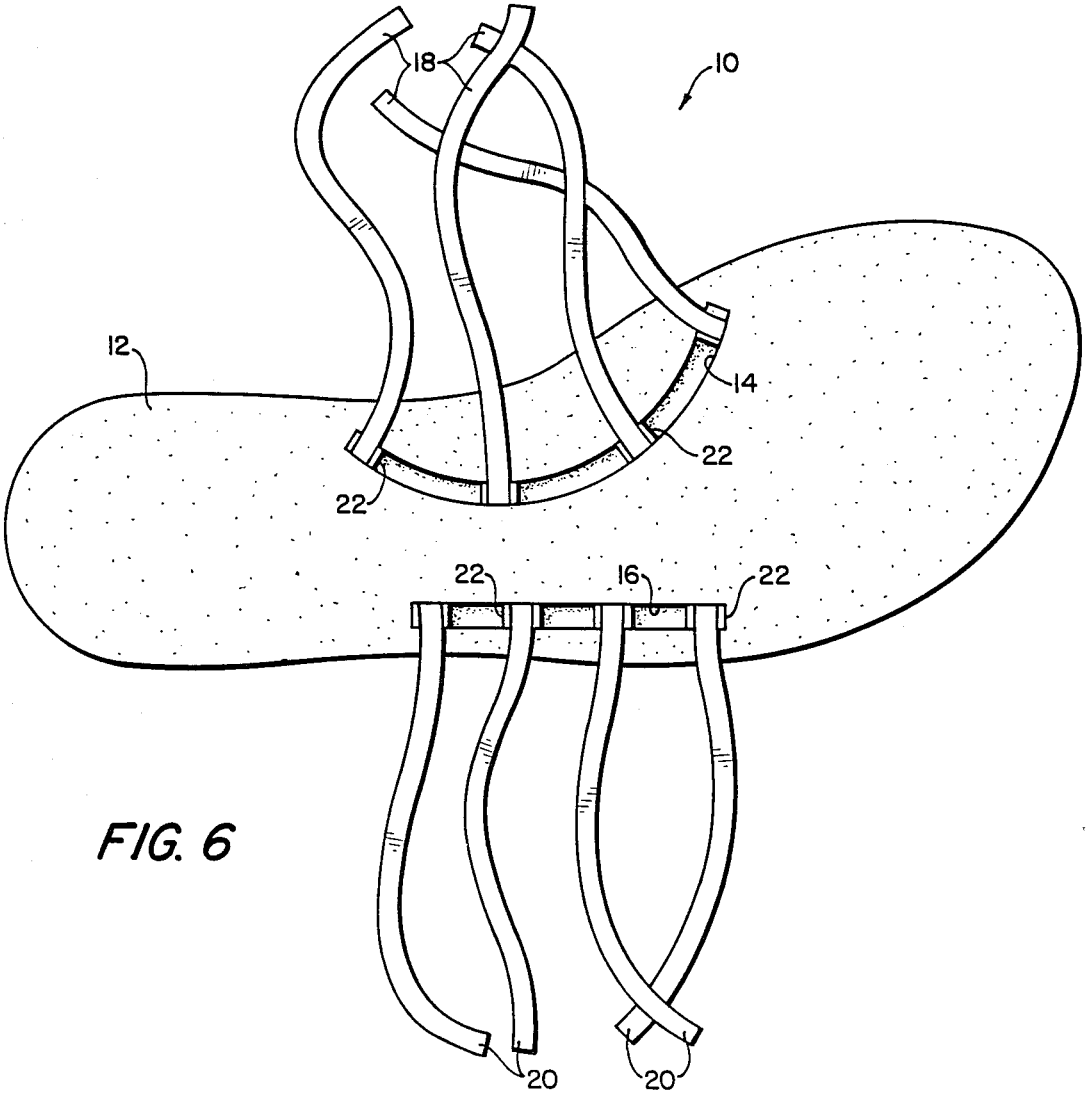
FIG. 6

FIG. 10
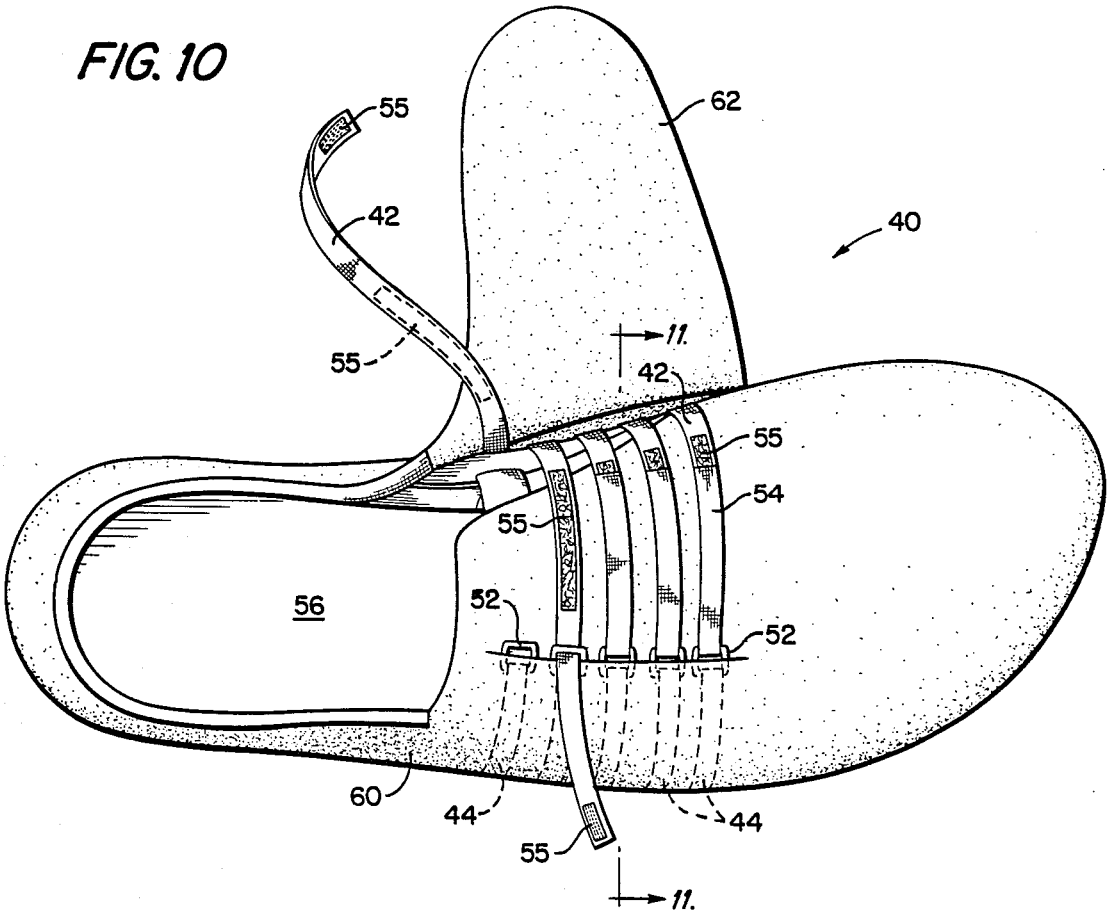
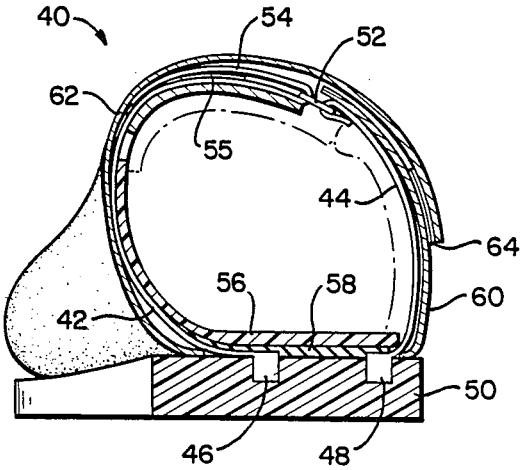
FIG. 11

TRANSVERSE SUPPORT SLING

BACKGROUND AND SUMMARY OF THE INVENTION

The present invention relates to a support structure for the foot. More particularly, the present invention relates to a shoe construction formed of sling straps which may be anchored into the lateral border of the top of the outsole of a shoe under the lower, lateral column of the foot. The straps are then carried over the top of the midfoot and allowed to fan out with attachment to the outsole under the upper, medial column of the foot so as to optimally support the upper column when the foot is loaded.

In an attempt to understand the foot as a system, the various parameters which affect the function of the foot have been studied, particularly with regard to a weight bearing foot. The practical need for such knowledge lies in the fact that a true structural model of the foot is capable of providing a prediction of gait and the effects of a shoe on gait. By knowing, in advance, how a shoe would affect the performance of an athlete, for example, optimum shoes could be designed without the usual "cut and try" method of standard shoe development.

The traditional model of the foot provides for a one column, two-axis model which maintains that the foot under load is a rigid structure with a talocrural (ankle) axis and an apparent subtalar axis. The front of the foot is relatively rigid, but with only a multitude of small bone movements about the midtarses axes. The average direction of the effective axis under the ankle, called the subtalar axis, is said to be 42 degrees vertical and 16 degrees horizontal to the midline of the body, as measured by Inman, V. T., *The Joints of the Ankle,* The Williams & Wilkins Co., Baltimore, 1976. However, this theory does not hold up with regard to a weight bearing or loaded foot since, if the force due to body weight were to act on the single traditional subtalar axis, the foot would collapse mechanically.

It has now been determined that the foot is comprised of two columns and three axes. The lower, lateral column is basically a rigid base comprised of the Calcaneus, Cuboid, and the fourth and fifth metatarsals. The remainder of the foot, which is comprised of the navicular, the first, second and third cuneiforms and the first, second and third metatarsals, emanates from the talus at the talonavicular interface swinging in combination with the lower column inversion/eversion actions in what may be called the 'subtalar joint axis'. But this articulation of what is called the upper foot column is only secondary to the true foot mechanism. The primary mechanical loading interface is on the lower, lateral column at the rear of the talus onto the calcaneus, the posterior talocalcaneal facet.

It has also been determined that the foot operates differently under load than when it is passively manipulated such as a doctor would do in the office. This distinction helps to explain previous misconceptions as to how the foot works under load.

This new understanding has yielded a new structural model of the foot which has two separate columns, wrapped together with fascia, and three nearly orthogonal axes. The three axes are: (1) the talocrural (ankle) axis; (2) the talocalcaneal axis (formed at the facet between the talus and the calcaneus); and (3) the talonavicular axis (formed at the facet between the talus and the navicular bones).

The transverse support sling of the present invention represents a novel structure which is based on providing maximum foot support in the midfoot region in accordance with the two column foot model. The advantages of the transverse support sling of the present invention over the prior art structures include the act that the position of the foot relative to the shoe is maintained because the transverse sling is anchored into the outsole. This is accomplished without pulling or pushing the medial longitudinal arch to the shoe.

The transverse sling straps of the present invention are positioned relative to the outsole of the shoe so as to coincide with certain anatomical landmarks of the foot. Thus the sling straps include anterior and posterior straps on the lateral side of the shoe and anterior and posterior straps on the medial side of the shoe. One or more additional straps are spaced between the anterior and posterior straps on each side of the outsole. The straps are so positioned that the anterior lateral strap is posterior to the fifth metatarsal head. The posterior lateral strap passes across the foot proximate and adjacent the calcaneal-cuboid joint. The anterior medial strap must be directed posterior to the first metatarsal head. The posterior medial strap must be directed posteriorly, after passing proximate and adjacent the navicular protuberance.

The sling straps may be mounted in respective medial and lateral slots provided in the outsole. Alternatively, an end portion of each of the sling straps may be adhered directly to the upper surface of the outsole without the use of slots. The straps are each capable of serving as separate and independent lines of force which are necessary to provide the proper support for the midfoot region of the foot.

The medial slot of the outsole is in the form of an arcuate shape which lies beneath three anatomical points of the foot: (1) the posterior edge of the first metatarsal head; (2) the second or third cuneiform, preferably the third cuneiform; and (3) the medial side of the calcaneus. The straps are free of attachment to the outsole medially inwardly toward the medial edge of the outsole from the arcuate shape defined by the three anatomical points. It is noted that a smooth arcuate shape is only relevant to a smooth groove in the outsole, whereas individually anchor points would align to the direction of the strap.

The lateral slot of the outsole lies under the lower column of the foot throughout the length of the slot. This slot which is generally linear thus extends from the posterior edge of the fifth metatarsal head to a position proximate and adjacent the calcaneal-cuboid joint.

By the present invention, a larger percentage of the population can be properly fitted into a given length shoe, thereby reducing factory inventory. In addition, the sling dimensions and forces must be maintained until a manual readjustment is made.

Accordingly, it is a primary object of the present invention to anatomically enhance the structural support of the foot according to the two column, three axis foot model.

It is another object of the invention to provide a support sling construction with attachment to the shoe outsole such that adjustment is completely independent of rearfoot and forefoot fit.

It is a further object of the invention to provide a support sling construction which is adjustable to custom fit the midfoot for ninety percent of the statistical range of girths for a given foot length.

An additional object of the invention is to provide a transverse support sling in which the sling dimensions will remain unchanged after initial adjustment.

It is a further object of the invention to provide efficient, repeatable, ergonomic girthing adjustment, due to relatively inextensible sling straps.

BRIEF DESCRIPTION OF THE DRAWINGS

FIG. 1 is a diagram showing a posterior view of a conventional right shoe construction.

FIG. 2 is a diagram showing a posterior view of the improved shoe construction of the present invention.

FIG. 3 is a perspective view of a measured average foot.

FIG. 4 is a perspective view showing a diagram of midfoot girth lines with outsole anchor points as employed in the improved transverse support sling of the present invention.

FIG. 5 is a plan view of an outsole constructed in accordance with the present invention.

FIG. 6 is a plan view of an outsole with sling straps in accordance with a first embodiment of the invention.

FIG. 10 is a plan view of a shoe incorporating the transverse support sling of the present invention.

FIG. 11 is a transverse sectional view taken along line 11—11 of FIG. 10.

DESCRIPTION OF THE PREFERRED EMBODIMENTS

Figure 7:
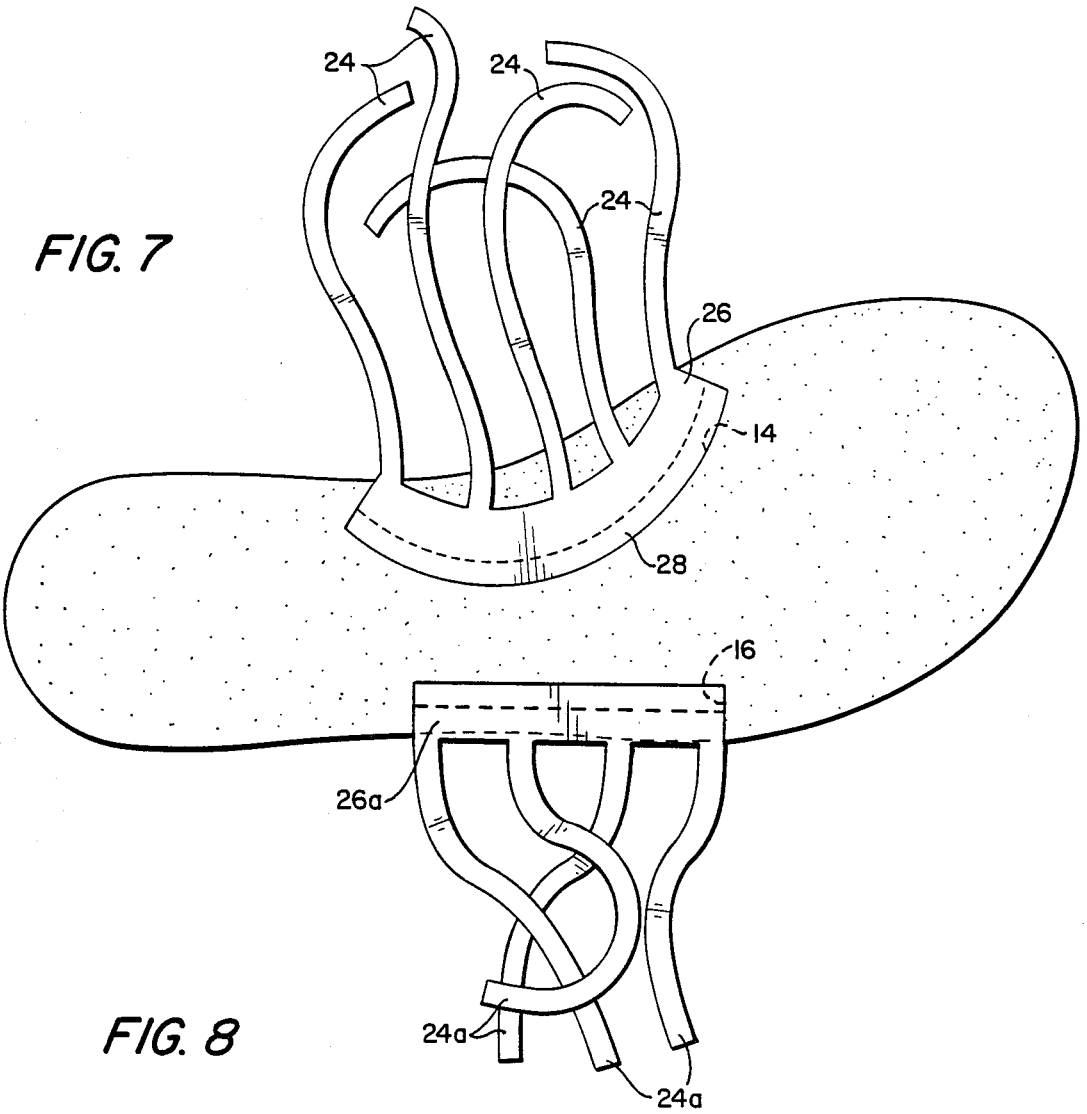
FIG. 7 is a plan view of an outsole with sling straps in accordance with a second embodiment of the invention.

FIGS. 1 and 2 provide a comparison of the shoe construction of the present invention with conventional construction of the prior art. In FIG. 1 which shows a diagram of a two column foot in a conventional shoe, the forces on a loaded foot in the midfoot region are directed downwardly on the arch area compressing the foot against an arch pad or shape, being directed through the longitudinal axis of the upper column. In FIG. 2, which shows a diagram of a two column foot in a shoe of the present invention, the forces on a loaded foot in the midfoot region are directed laterally through the longitudinal axis of the upper column.

In FIG. 3 of the drawings there is shown a perspective view of a measured average foot. In FIG. 4, the midfoot girth lines 17 are represented for the shoe construction of the present invention, showing a diagram of the outsole, anchor slots 19 and general direction of girthing for the present transverse support sling.

In the embodiment of the invention as shown in FIGS. 5 through 11, there is provided a transverse support sling 10 of the present invention which is so called since it is adapted to be attached directly to the relatively firm outsole in such a way as to support the medial arch in a sling fashion.

In FIG. 5, there is shown an outsole 12 having medial 14 and lateral 16 slots provided in the midfoot region. Each of the slots 14, 16 is of sufficient depth to allow the respective slot to receive one end of the sling straps and maintain the connection of the straps at or below the level of the top of the outsole. The medial slot 14 has an arcuate shape extending under the arch of the foot. The lateral slot 16 is generally linear and extends substantially parallel to the lateral edge of the outsole. Both slots 14, 16 are positioned in the upper surface of the outsole 12 so as to lie beneath the foot of the wearer.

In the embodiment of the invention as shown in FIG. 6, strap means in the form of plurality of sling straps 18 on the medial side of the foot are positioned with one end of each strap 18 secured in arcuate medial slot 14 of outsole 12. A corresponding plurality of sling straps 20 on the lateral side are positioned with one end of each strap 20 secured in lateral slot 16. The straps 18, 20 are secured by means of tabs 22 which are individually attached to the inner end of each sling strap 18, 20 and then secured by adhesive or other means within the respective slot 14, 16, with the tabs 22 being of a size which will not extend above the top of the outsole 12 and which allows the inner end of each strap 18, 20 to lie smoothly along the upper surface of the outsole 12.

In the embodiment as shown in FIG. 7, strap means in the form of sling straps 24 are formed as a single piece construction with rib member 26 with the straps 24 being spaced along the length of the rib 26. The rib 26 is of a length equal to that of the arcuate medial slot 14 and the portion of the rib 26 along one longitudinal edge 28 is of thicker, reinforced construction to facilitate securing of the edge 28 in the slot 14 along the length thereof. A similar one-piece rib **26*a* and sling strap 24*a* construction may be provided for attachment to lateral slot 16**.

Figure 8:
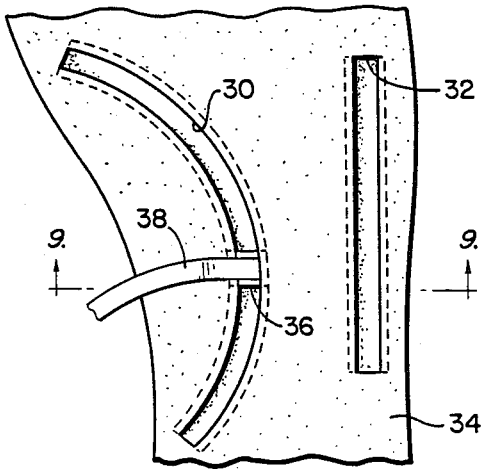
FIG. 8 is a partial plan view showing a third embodiment of the invention.
Figure 9:
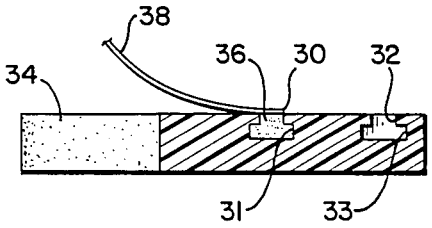
FIG. 9 is a cross sectional view taken along line 9—9 of FIG. 8.

The embodiment of the invention as shown in FIGS. 8 and 9 includes slots 30, 32 which are formed with an enlarged cross section 31, 33 at the respective inner ends thereof. The slots 30, 32 thus function as channels in the upper surface of the outsole 34, for the purpose of receiving one or more tabs 36 each connected to a respective sling strap 38. Each tab 36 is slidably mounted in the respective slot 30, 32 and capable of movement along the length of the track or channel formed by each slot 30, 32.

In FIGS. 10 and 11 there is shown a shoe upper 40 having the transverse support sling of the invention installed therein. As shown in FIG. 11, strap means in the form of the medial 42 and lateral 44 sling straps extend up and over the foot from their points of attachment to respective tabs 46, 48 embedded in outsole 50. Medial strap 42 passes through a buckle 52 fastened at the upper end of the corresponding lateral strap 44. The medial strap 42 is then folded back so that its outer end 54 may be secured to the outer surface of a portion of the strap 42 itself by means such as hook and pile retention means, generally identified in the trade as a Velcro attachment 55.

An insole and inner liner member 56 is secured to the insole base 58 which itself is secured over the tab and sling strap connection to the outsole 50. The upper 40 is provided with an inner 60 and outer 62 flap at the midfoot region. These flaps 60, 62 may be releasably secured by any suitable means such as a Velcro attachment 64. As shown in FIG. 10, the inner flap 60 may be continued across the vamp of the shoe.

In each of the embodiments of the present invention, the construction and location of the sling straps is specified according to recognized anatomical landmarks. Thus the anterior lateral strap must be posterior to the fifth metatarsal head. Also, the posterior lateral strap should pass metatrsal head. Also, the posterior lateral strap should pass across the foot proximate and adjacent the calcaneal-cuboid joint. The anterior medial strap must remain posterior to the first metatarsal head. The posterior medial strap must be directed posteriorly, after passing proximate and adjacent the navicular protuberance. The medial 14 and lateral 16 slots are of sufficient length to allow the straps to attain these anatomical positions. One or more additional straps, as desired, are spaced between the anterior and posterior straps on each side of the outsole.

The medial attachment points in the medial slot approximately form an arc under the arch. The transverse support sling must provide a plurality of distinct sling straps in order for them to fan out into this medial arc. The sling straps must be strong and relativeley inextensible, and, very importantly, they must be capable of being adjusted for length independent of one another. The sling straps on both the medial and lateral sides of the foot should not have a stiff covering or be adhered to a stiff upper which would interfere with the independent adjustment of the straps.

The term "relatively inextensible" should be defined for the purposes of the present invention. Conventional shoe laces are typically woven structures in which fiber alignment provides that large strains must be produced before a significant load can be handled. One typical shoe lace strained 5% but carried a load of only five pounds. While a shoe lace has a continually increasing modulus, it is more beneficial, with regard to the present invention, for the support sling fibers to have a significant initial modulus which remains linear throughout the effective support range. Such a properly allows significant forces to be supported at much lower strains. This is the inextensibility required for the support sling straps of the present invention.

The medial anchor points may advantageously be slidable as shown in FIGS. 8 and 9 in order to further enhance the customization of the fit. The methods of anchoring, strap adjusment and locking means can be achieved in many ways.

The strap geometry and specific mechanical properties can be varied as long as minimum strength and stiffness of the sling straps are maintained without introducing local pressures to the foot.

The hoop which includes the medial and lateral straps and the portion of the outsole between the medial and lateral anchor points should not strain or elongate more than about 10% under body loads of the order of two to three body weights. Generally, the greatest strap loadings will occur during action such as intense running and such loadings would be carried during the gait cycle first by the rear straps and then would move forward during the midstance of the gait cycle. The act of standing would tend to distribute the loads more evenly.

The methods of maintaining the relative positions of the straps may be varied, for example, by bonds to the upper fabric and/or some additional scrim cloth.

The transverse support sling of the present invention allows good longitudinal flexibility when the foot rolls. It is necessary for the upper and lower column of the foot to rotate with respect to each other as the foot is loaded and unloaded while walking. The sling straps provide separate and independent lines of force which are instrumental in providing the necessary support. By girthing in this manner, a broader range of sizes can be obtained. Also, the sling straps hold the foot to the outsole while lifting the shoe upper securely around the foot.

The sling straps employed in the present invention could be any of various constructions, such as a flat strap of narrow width or a monofilament material with cushioning material underneath to protect the foot tissue. If the straps are too wide, however, they will tend to lift off the foot at certain points, thus creating excessive local pressures on the foot. Wide inextensible straps will have directionality problems and will cause local pressure points. Wide straps also take away from the ability to adjust the straps properly. As an example of a strap which may be employed in the present invention, a polyester ribbon strap having a width of about $\frac{3}{8}$ inch and a modulus of about 525 pounds per inch per inch has been used with good results. At least five medial and five lateral straps of this type were employed in one embodiment and the overall contact area for the Velcro fasteners of the straps was approximately $2\frac{1}{2}$ square inches. In this embodiment, a polyurethane outsole having a thickness of about $\frac{1}{2}$ inch and a Shore A hardness of about 50 durometer was employed.

By the present invention, there is provided a support sling construction which is adjustable to custom fit the midfoot for ninety percent of the statistical range of girths for a given foot length. Standard deviation calculations show that an adjustment of $\pm 10\%$ would fit ninety percent of the girths. As an example, for a size 9 man's foot having an average girth of 10 inches, this results in the need for 2 inches of adjustment in the sling straps to satisfy the ninety percent requirement.

It is a goal of the invention to provide uniform lines of force consistent with the force required to maintain the necessary support. The identification of the two column nature of the foot has allowed the formation of the present girth structure which is attached to the outsole based on the location of each of the two columns. By attaching the sling straps under the upper column on the medial side, the support for the arch which is thus provided serves to eliminate the necessity for any sort of arch "cookie" such as that shown in FIG. 1. Some foam or other interfacing material may be employed as desired to avoid local pressures.

The closure device for the sling straps may be of any conventional type which is relatively inextensible so as to provide a small degree of looseness upon first tightening the straps with minimal or no load on the foot.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A foot support structure which is attached to the outsole of a s hoe so as to provide support to the medial arch of a foot in a sling configuration, comprising:

a shoe outsole; and a plurality of sling straps attached to said outsole so as to extend generally transverse to the longitudinal axis of said outsole, said sling straps being attached to the upper surface of said outsole at a position below the upper column of the foot, wherein the upper column of the foot is defined as including the navicular, the first, second and third cuneiforms and the first, second and third metatarsals, said position of attachment of said sling straps below the upper column of the foot being defined by an arcuate slot which lies beneath three anatomical points of the foot, said points including the posterior edge of the first metatarsal head, the second or third cuneiform and the medial side of the calcaneus.

2. The foot support structure of claim 1 wherein said sling straps attached below the upper column of the foot are mounted in said arcuate slot by means of tabs which are individually attached to the inner end of each of said sling straps and secured within said slot, said tabs being of a size which will not extend above the top of the outsole and which allows the inner end of each strap to lie smoothly along the upper surface of the outsole.

3. The foot support structure of claim 1 wherein said sling straps attached below the upper column of the foot are formed as a single piece construction joined by a rib member with the straps being spaced along the length of the rib, said rib having a portion thereof secured within said arcuate slot.

4. The foot support structure of claim 1, further including means for slidably mounting within said arcuate slot the inner ends of the sling straps attached below the upper column of the foot, thus allowing the inner ends of said sling straps to move along the length of said arcuate slot.

5. A foot support structure which is attached to the outsole of a shoe so as to provide support to the medial arch of a foot in a sling configuration, comprising:

a shoe outsole; and a plurality of sling straps attached to said outsole so as to extend generally transverse to the longitudinal axis of said outsole, at least one of said sling straps being attached to said outsole at a position below the upper column of the foot, and with a plurality of sling straps being attached to the upper surface of said outsole at a position below the lower column of the foot, wherein the upper column of the foot is defined as including the navicular, the first, second and third cuneiforms and the first, second and third metatarsals, and wherein the lower column of the foot is defined as being in the form of a base which includes the calcaneus, cuboid and the fourth and fifth metatarsals, said position of attachment of said plurality of sling straps below the lower column of the foot being defined by a generally linear slot which extends from beneath the posterior edge of the fifth metatarsal head to a point beneath the calcaneal-cuboid joint, said sling straps attached below the lower column of the foot being mounted in said linear slot by means of tabs which are individually attached to the inner end of each of said sling straps and secured within said slot, said tabs being of a size which will not extend above the top of the outsole and which allows the inner end of each strap to lie smoothly along the upper surface of the outsole.

6. A foot support structure which is attached to the outsole of a shoe so as to provide support to the medial arch of a foot in a sling configuration, comprising:

a shoe outsole; and a pluralitiy of sling straps attached to said outsole so as to extend generally transverse to the longitudinal axis of said outsole, at least one of said sling straps being attached to said outsole at a position below the upper column of the foot, and with a plurality of sling straps being attached to the upper surface of said outsole at a position below the lower column of the foot, wherein the upper column of the foot is defined as including the navicular, the first, second and third cuneiforms and the first, second and third metatarsals, and wherein the lower column of the foot is defined as being in the form of a base which includes the calcaneus, cuboid and the fourth and fifth metatarsals, said position of attachment of said plurality of sling straps below the lower column of the foot being defined by a generally linear slot which extends from beneath the posterior edge of the fifth metatarsal head to a point beneath the calcaneal-cuboid joint, said sling straps attached below the lower column of the foot being formed as a single piece construction joined by a rib member with the straps being spaced along the length of the rib, said rib having a portion thereof secured within said linear slot.

7. A foot support structure which is attached to the outsole of a shoe so as to provide support to the medial arch of a foot in a sling configuration, comprising:

a shoe outsole; and a plurality of sling straps attached to said outsole so as to extend generally transverse to the longitudinal axis of said outsole, at least one of said sling straps being attached to said outsole at a position below the upper column of the foot, and with a plurality of sling straps being attached to the upper surface of said outsole at a position below the lower column of the foot, wherein the upper column of the foot is defined as including the navicular, the first, second and third cuneiforms and the first, second and third metatarsals, and wherein the lower column of the foot is defined as being in the form of a base which includes the calcaneus, cuboid and the fourth and fifth metatarsals, said position of attachment of said plurality of sling straps below the lower column of the foot being defined by a generally linear slot which extends from beneath the posterior edge of the fifth metatarsal head to a point beneath the calcaneal-cuboid joint, and further including means for slidably mounting within said linear slot the inner ends of the sling straps attached below the lower column of the foot, thus allowing the inner ends of said sling straps to move along the length of said linear slot.

8. A foot support struture which provides support to the midfoot region of a foot, comprising:

a shoe member having a medial side and a lateral side; and strap means for securing the foot to said shoe member, said strap means having a first position of attachment to said shoe member at a position directly below the upper column of the foot, wherein said upper column of the foot is defined as including the navicular, the first, second and third cuneiforms and the first, second and third metatarsals and wherein said position directly below the upper column of the foot is defined by an arch which lies beneath three anatomical points of the foot, said points including the posterior edge of the first metatarsal head, the second or third cuneiform and the medial side of the calcaneus, said strap means being free of attachment to said shoe member medially inwardly toward the medial edge from said first position of attachment directly below the upper column of the foot; and with said strap means having a second position of attachment to said shoe member at a position below the lower column of the foot, wherein said lower column of the foot is defined as being in the form of a base which includes the calcaneus, cuboid and the fourth and fifth metatarsals.

9. The foot support structure of claim 8 wherein said strap means includes sling straps with anterior and posterior straps on the lateral side of the shoe member and anterior and posterior straps on the medial side of the shoe member, said anterior lateral strap being positioned along the length of the shoe member to overlie and pass posterior to the fifth metatarsal head of the foot, said posterior lateral strap being positioned along the length of the shoe member to overlie and pass across the foot proximate and adjacent the calcaneal-cuboid joint of the foot, said anterior medial strap being positioned along the length of the shoe member to overlie and be directed posterior to the first metatarsal head of the foot, and with said posterior medial strap being positioned along the length of the shoe member to overlie and be directed posteriorly after passing proximate and adjacent the navicular protuberance of the foot.

10. The foot support structure of claim 8 wherein said strap means includes sling straps which are of a relatively inextensible material.

11. The foot support structure of claim 8 wherein said strap means is adjustable for length.

* * * * *